US005626504A

United States Patent [19]

Liu

[11] Patent Number: 5,626,504

[45] Date of Patent: May 6, 1997

[54] TOY VEHICLE AND TRACK ASSEMBLY

[76] Inventor: Ting Liu, 1006 Chelsea Pl., Matthews, N.C. 28105

[21] Appl. No.: 252,752

[22] Filed: Jun. 2, 1994

Related U.S. Application Data

[63] Continuation-in-part of Ser. No. 979,163, Nov. 19, 1992, abandoned.

[51] Int. Cl.[6] ..... A63H 21/02; B61B 13/00

[52] U.S. Cl. ..... 446/229; 446/444; 446/455; 104/118; 104/53; 238/10 R

[58] Field of Search ..... 446/229, 228, 446/230, 231, 232, 438, 444, 445, 446, 454, 443, 455; 104/87, 118, 125, 126, 120, 53

[56] References Cited

U.S. PATENT DOCUMENTS

| | | | |
|---|---|---|---|
| 2,562,648 | 7/1951 | Sparrow | 463/52 |
| 2,754,432 | 7/1956 | Mostek | 307/140 |
| 3,477,172 | 11/1969 | Polewski | 446/445 |
| 3,604,148 | 9/1971 | Neuhierl | 104/118 |
| 3,675,361 | 7/1972 | Schlau et al. | 446/228 |
| 4,034,678 | 7/1977 | Wilson | 446/446 |
| 4,055,021 | 10/1977 | Okamoto | 463/63 |
| 4,187,637 | 2/1980 | Nielsen | 446/444 |
| 4,537,577 | 8/1985 | Sansome et al. | 446/445 |

*Primary Examiner*—Mickey Yu

*Attorney, Agent, or Firm*—Shefte, Pinckney & Sawyer

[57] ABSTRACT

A toy vehicle and track assembly includes an electrically operable vehicle for movement along an elongate flexible track of a predetermined length having flexible electrical conductors along the longitudinal extent thereof. The vehicle is configured for an actual direction of travel and an apparent direction of travel and includes an arrangement for maintaining the actual direction of travel coincident with the apparent direction of travel. Power is supplied to the vehicle through a hand-held controller wired to a power application device which clamps on the track. The track may be formed with one of several cross-sectional configurations providing additional surfaces for the placement of conductive electric strips which apply power to the vehicle and to optional auxiliary systems within the vehicle. A plurality of mounting tunnels are provided to allow the track to be erected in a number of predetermined circuit designs and, optionally, power may be applied to the track through one of the mounting tunnels.

52 Claims, 10 Drawing Sheets

TOY VEHICLE AND TRACK ASSEMBLY

CROSS-REFERENCE TO RELATED APPLICATION

The present application is a continuation-in-part of U.S. patent application Ser. No. 07/979,163, abandoned.

BACKGROUND OF THE INVENTION

This invention relates to self-propelled toy vehicle and track assemblies and more particularly to a self-propelled toy vehicle with a flexible track which passes through the vehicle for controlled vehicle travel therealong.

Toy vehicle and track assemblies in which a toy vehicle moves along a continuous track are well known, and several types of toy track and vehicle assemblies are currently available. The most popular type includes a continuous track having several continuous, generally parallel grooves formed therein and extending longitudinally the full extent of the track. The associated vehicles have pins projecting outwardly therefrom which engage the grooves to keep the vehicles on the track. Typically, onboard electric motors drive the vehicles along the track with power being supplied to continuous metallic electrical conductors which extend parallel to the grooves to provide positive and negative contacts for the operation of the motor. Invariably, these motors are DC motors due to the safety associated therewith. Speed variations associated with the vehicles are provided through hand-held rheostats which vary the voltage applied to the electric motor and therefore vary the motor output. The motor will typically drive the rear wheels of a vehicle through a gearing system.

These tracks work well at relatively low vehicle speeds and when the track is at least moderately level. Also, these tracks are usually formed of rigid track sections which limit variation of the track orientation and configuration. Even so, in situations where the track turns upside down, loops, or climbs sharply upward, gravity takes over and the car may not stay on the track. This disrupts play and limits the possible track configurations for such toy vehicle and track assemblies. Additionally, conventional tracks are typically rigid and formed in sections which must be assembled prior to operation. The sections are usually formed in predetermined lengths and shapes, generally being straight sections of various lengths, curves of predetermined radii, and sometimes "special" configurations such as intersections or loops. Accordingly, the track sections are assemblable into limited overall configurations and the plurality of track sections results in a large number of section-to-section joints which can cause electrical discontinuity resulting in disrupted play. The sectional approach to track configuration also results in numerous small links required to hold the sections together which can be lost and also results in large packaging requirements which increase in size as track length and, therefore, the number of required sections increases. Sectional track portions also use rigid steel conductors which limit the possible track length because of the higher resistivity associated therewith.

Further, most current vehicle and track assemblies are limited to automobiles, trucks, or other essentially land-based vehicles. The vehicles could be configured as airplanes or space craft, yet even the most vivid imaginations would find difficulty with an airplane or a space craft on what is essentially a scale model roadway. Additionally, the control mechanisms which allow interactive play are typically limited to speed control and no other functions such as lights, gunfire, or sirens, if available at all, can be controlled by the user.

Currently, an airplane-based product is available, however, a rigid track is provided in sections connected with a T-type connector. Another current product provides a flexible U-shaped track, however, the vehicle associated therewith is a car propelled by an onboard battery. There is no electrical contact between the car and the track and, consequently, there is no user control over the car, and no interaction between the user and the vehicle and track apparatus, thereby limiting the enjoyment to be derived therefrom.

SUMMARY OF THE INVENTION

It is accordingly an object of the present invention to provide a toy vehicle and track assembly wherein the driving mechanism of the vehicle remains in contact with the track even when the track curves sharply upwardly or is upside down. It is a further object of the present invention to provide a toy vehicle and track assembly having a flexible track which may be operated in a variety of different configurations and track lengths. In addition, the present invention provides a track assembly which may be selectively mountable to a variety of supporting objects and is operable when spaced a distance above the ground thereby giving added realism to space craft or airplane-like vehicles.

According to the present invention, a toy vehicle and track assembly includes an electric power source and a track formed as an elongate flexible member of a predetermined length having flexible electrical conductors along the longitudinal extent thereof. A vehicle is provided having an arrangement for connecting the vehicle to the track, an onboard electric motor, an arrangement for connecting the vehicle motor to the track conductors for electrical communication with the power source, and a drive arrangement driven by the electric motor and disposed for engagement with the track for propelling the vehicle along the track in an actual direction of travel. The vehicle includes a front end and back end defining an apparent direction of travel with the front end projecting in the apparent direction of travel. An assembly is provided for maintaining the apparent direction of travel coincident with the actual direction of travel and a control assembly is provided for selectively connecting and disconnecting the electric power source with the conductors and for controlling the actual direction of travel of the vehicle.

According to the preferred embodiment of the present invention, the control assembly includes a switch for changing the actual direction of travel of the vehicle and the directional maintaining assembly reverses the apparent direction of travel responsive to switch action. The directional maintaining assembly includes a gear train connected to the electric motor and configured to rotate the vehicle about an axis generally orthogonal to the actual direction of travel and a stop member disposed in communication with the vehicle to arrest rotation when the vehicle front end projects in the actual direction of travel. The gear train is disposed within a housing removably mountable to the track and the vehicle is rotatably mounted to the housing. Preferably, the electric motor and the drive assembly are both disposed within the gear train housing.

According to one preferred embodiment of the present invention, the track defines a plurality of longitudinal slots extending substantially the full longitudinal extent of the track and the electric conductors include a plurality of flexible electrically conductive strips disposed within the slots. Further, the assembly for connecting the electric motor to the conductors includes a plurality of electrically conductive pin members mounted to the vehicle in communication with the electric motor and resiliently biased into contact with the electrically conductive strips when the vehicle is disposed on the track.

Preferably, the control arrangement includes a power application device and a hand-held controller in electrical communication therewith, the power application device being selectively removably mountable to the track in electrical communication with the electrically conductive strips. The power application device includes a housing for selective attachment to and detachment from the track and the plurality of pin members disposed within the housing for electrical contact with the conductive strips, the pin members being in electrical communication with the electric power source for application of electric power to the conductive strips. It is preferred that the hand-held controller include the electrical power source in the form of at least one dry cell battery.

According to one preferred embodiment of the present invention, the electrical conductors include at least three electrically conductive strips disposed along the longitudinal extent of the track, two of the strips being of positive polarity and one of the strips being of negative polarity. The invention then preferably includes at least two independently operable vehicle units, the electric motor of one of each of the vehicle units being in independent electrical communication with one of the positive polarity conductive strips and the electrical motor of the at least to vehicular units being in common electrical communication with the negative polarity conductive strip for independent, selectively controlled operation of at least two vehicular units on the track by application of electric power independently to each electric motor through connection to one of the positive polarity strips and the negative polarity strip. Each vehicular unit may be controlled by a hand-held controller as previously described and power may be applied to the track through a power application device which is selectively attachable to and detachable from the track, as also previously described. The electrical conductors may include a plurality of electrically conductive strips and each vehicular unit may include an electrically operable auxiliary system with the control arrangement including switches for selectively independently operating the auxiliary system. The auxiliary system may include a plurality of lights affixed to the vehicles and the lights may be selectively illuminable using the switch. Here, the electrical motor of each vehicular unit is in electrical communication with one of the positive polarity strips and the negative strip and each vehicular unit auxiliary system is in electrical communication with one of the positive polarity strips and the negative polarity strip for independent selective operation of each vehicular unit electric motor and each vehicular unit auxiliary system.

Preferably, the drive arrangement includes a drive wheel and the track includes a drive surface extending therealong for contact with the drive wheel. The track may be formed with a predetermined cross-sectional configuration having a plurality of surfaces extending in separate longitudinal planes, at least one of the surfaces comprising the drive surface and at least two of the surfaces having the conductive strips disposed thereon. Preferably, at least one of the conductive strips is of a positive polarity and at least one of the strips is of a negative polarity. Accordingly, additional positive strips may be provided to operate auxiliary systems as previously described or for the operation of more than one vehicular unit on the track. Additionally, hand-held controllers and selectively attachable power application devices are equally adaptable to tracks of various cross sections.

According to another preferred embodiment of the present invention, the track is formed in a plurality of track sections, each of a predetermined length and includes an arrangement for detachably linking the track sections to form a continuous track. The linking arrangement includes a recess formed in one end of each track section and a corresponding projection formed in the other end of each track section, whereby a projection from one of the track sections is configured to mate with and be removably retained by a recess formed in the other of the track sections for removably retaining the track sections in a mated configuration. As may be expected, these detachable track sections may be formed with various cross-sections, may include a plurality of electrical strips, and may be used with the hand-held controllers and selectively attachable power application devices as previously described.

According to another preferred embodiment of the present invention, a mounting assembly is provided for mounting the track to a support object. The mounting arrangement includes at least one tunnel for supporting passage therethrough of the track. The tunnel includes an assembly for mounting the tunnel to a support object. The tunnel mounting arrangement includes an adjustable clamp for selective attachment to and detachment from a support object. The tunnels may be used to support either a continuous track or a plurality of linked track sections.

As an alternative method of power application to the track, at least one tunnel may include an assembly for communicating the electric power source with the conductors. This assembly preferably includes at least two displaceable conductive members of a positive polarity and at least two displaceable conductive members of a negative polarity projecting from the walls of the tunnel and being resilient biased into contact with the conductive strips. The conductive members are in electrical communication with the electric power source and are temporarily displaceable from contact with the conductive strips by contact with the vehicle as it passes through the tunnel and being biased into recontacting the conductive strips after the vehicle has traveled therepast. It is preferred that the conductive members be spaced a predetermined distance apart and that the distance between conductive members of like polarity is greater than the length of the vehicle.

It is preferred that the track mounting arrangement include a plurality of tunnels as previously described for supporting passage therethrough of the track. The tunnels may include an arrangement for removably mounting the tunnels to one another in a generally side-by-side relationship.

According to another preferred embodiment of the present invention, the toy vehicle and track assembly includes at least one electric power source and a track formed as a plurality of removably joinable track sections formed from elongate flexible members of a predetermined length having flexible electric conductors along the longitudinal extent thereof, the track including an arrangement for linking the track sections to form a single unitary track. At least one vehicle is provided as described above. This embodiment additionally includes a control arrangement for selectively connecting and disconnecting the electric power source with the conductors for controlling movement of the vehicle responsive to application of electric power to the electric motor and an arrangement for mounting the track to a support object and directing the route of the track. The mounting arrangement includes a plurality of tunnels for passage therethrough of the track, the tunnels including an arrangement for removably mounting the tunnels to support objects.

Preferably, the toy vehicle and track assembly of the present invention includes an arrangement for forming the track sections into at least two continuous track circuits and includes at least two vehicular units, each being independently operable on a respective track circuit. The tunnels include an arrangement for removably attaching the tunnels to one another for forming the at least two track circuits at least partially in a side-by-side relationship. This embodiment may also be provided with the hand-held controllers and the selectively attachable power application devices as described above. Further, the track sections may be formed with different cross-sections as also described above. Alternately, this embodiment may also include power application to the track circuits through the tunnels as previously described.

According to another preferred embodiment of the present invention, the toy vehicle and track assembly may be formed with the track as a singular elongate flexible member as previously described supported and directed by a plurality of tunnels as previously described. This embodiment preferably includes a track storage assembly located at one end of the track for storage and payout of any predetermined length of the track. The track storage assembly may include a housing and a winder within the housing connected to one end of the track for selective storage of the track by winding the track and selective payout of the track a predetermined length by unwinding the track. The control arrangement preferably includes a housing attached to the other end of the track and configured for hand-held operation. This embodiment further includes a mounting assembly attached to the storage arrangement for selectively mounting the other end of the track to a support object. Optionally a direct current storage battery may be contained within the control arrangement housing.

By the above, the present invention provides a toy vehicle and track assembly providing a wide array of track configuration options and a vehicle which provides realistic simulated flight by maintaining the apparent direction of travel coincident with the actual direction of travel. Further, a variety of power application devices are provided for enhanced flexibility with respect to track assembly and mounting.

DESCRIPTION OF THE PREFERRED EMBODIMENT

Figure 1:
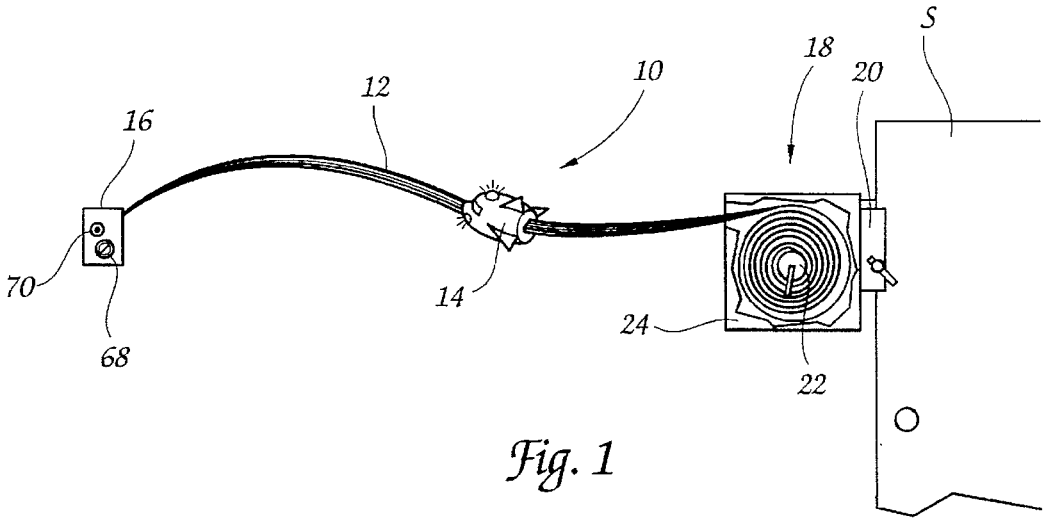
FIG. 1 is a perspective view of a toy vehicle and track assembly according to one preferred embodiment of the present invention.

Referring now to the accompanying drawings and more particularly to FIG. 1, a toy vehicle and track assembly is indicated generally at 10 and includes a track 12, a vehicle 14 configured to travel along the track 12, a controller 16, a track storage assembly 18, and a mounting clamp 20 affixed to the storage assembly 18.

The track 12 is a flexible elongate strip having the controller 16 fixed to one end and a winding assembly 22 fixed to the other end thereof. The winding assembly 22 is contained within the track storage assembly 18. The winding assembly 22 and the track storage assembly 18 will be explained in greater detailed hereinafter.

Figure 2:
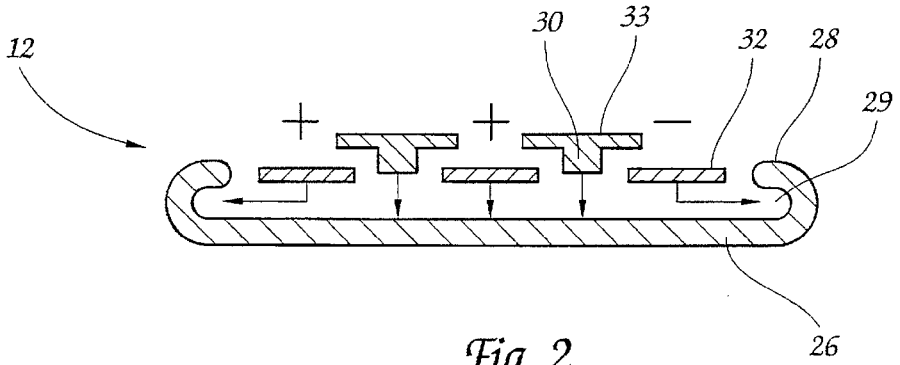
FIG. 2 is a cross-sectional view of the track of the present invention illustrating one preferred construction thereof.

The track 12 is preferably constructed according to one of several methods, however, any method of construction which yields the basic track structure is contemplated. With reference to FIG. 2, one preferred embodiment of the track construction is illustrated, the track being shown generally at 12. A track bed 26 is formed as a generally planar elongate member having side edges 28 curved upwardly and inwardly toward the center of the track bed 26 to form opposing, generally C-shaped recesses 29 laterally spaced along either side edge 28 of the track bed 26. Generally elongate members 30, T-shaped in cross-section, are applied to the track bed 26 at generally equally spaced intervals between the C-shaped recesses 29 and extend substantially the full longitudinal extent of the track bed 26. Three generally planar elongate metallic electrical conductor strips 32 are fitted in the slots formed by the C-shaped recesses 29 and the affixation of the T-shaped members 30 and extend substantially the full longitudinal extent of the track 12. Accordingly, this construction of the track 12 of the present invention provides a generally planar track bed 26 having three electrical conductors 32 fitted thereto and two raised surfaces 33 provided by the upper surfaces of the T-shaped members 30. The surfaces 33 will act as driving surfaces, which will be explained in greater detail hereinafter.

Figure 3:
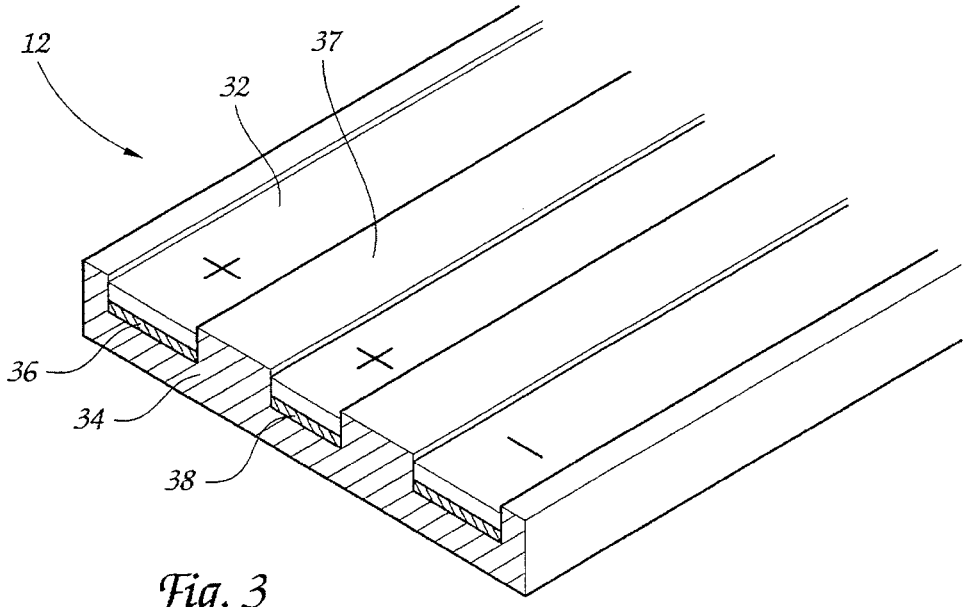
FIG. 3 is a perspective cross-sectional view of a track according to the present invention illustrating another preferred construction thereof.

According to another preferred method of construction of the track 12 of the present invention, and with reference of FIG. 3, a generally planar rectangular elongate track bed 34 is formed with three generally parallel laterally spaced rectangular recessed slots 36 in the upper surface thereof which extend substantially the full longitudinal extent of the track bed 34. Metallic electrical conductor strips 32 are configured to fit within the slots 36 and are affixed thereinto using a flexible adhesive 38. The conductors 32 extend substantially the full longitudinal extent of the track bed 34. By this construction, drive surfaces 37 are provided by the configuration of the second track bed 34 intermediate the electrical conductors 32. Both methods of track construction utilize a resilient flexible material for the track bed construction. Further, because the conductors are flexible and continuous, they can be formed of highly conductive copper, providing the potential for greater track length. According to the present invention, track arrangement is variable and may be set up in any number of configurations by the user. Further, track length is variable and may extend as long as 100 to 150 feet, limited only by the available battery power and the conductivity of the electrical conductors.

Figure 12A:
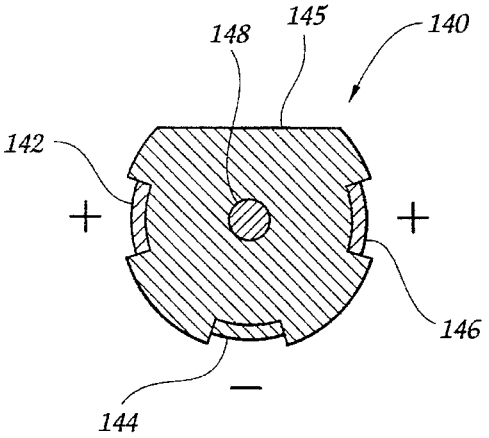
FIG. 12 illustrates two cross-sectional arrangements for the track of the present invention, FIG. 12*a* illustrating a semi-circular configuration and FIG. 12*b* illustrating a hexagonal configuration.
Figure 12B:
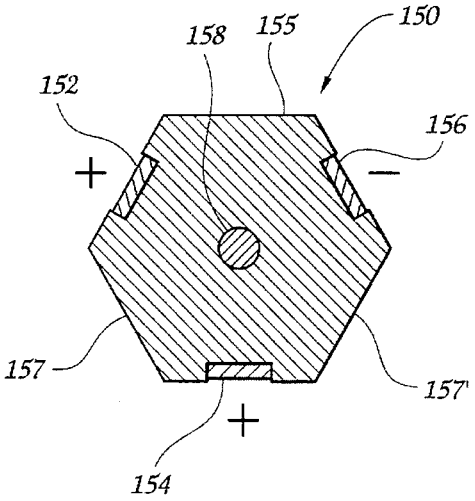

Track configuration is not limited to flattened track portions with parallel, aligned conductors. As illustrated in FIGS. 12*a* and 12*b*, the track may be formed with different geometric cross-sections. Looking first at FIG. 12*a*, a track 140 is formed with a partially round cross-section. With this type of track construction, the electrical conductors 142,144, 146 are disposed at equally spaced circumferential positions along the curved portion of the track 140. A drive surface 145 is formed in the track 140 as a flattened portion.

Alternatively, and as seen in FIG. 12*b*, a hexagonal track 150 includes surfaces in which three electrical conductors 152,154,156 are disposed at equal angular positions around the hexagon. A drive surface 155 is provided by one of the surfaces not containing an electrical conductor. The remaining surfaces 157,157' are available for additional electrical conductors for providing additional functions such as an increased number of auxiliary systems or to allow the use of two vehicles simultaneously on one track, as will also be explained in greater detail hereinafter.

Figure 5:
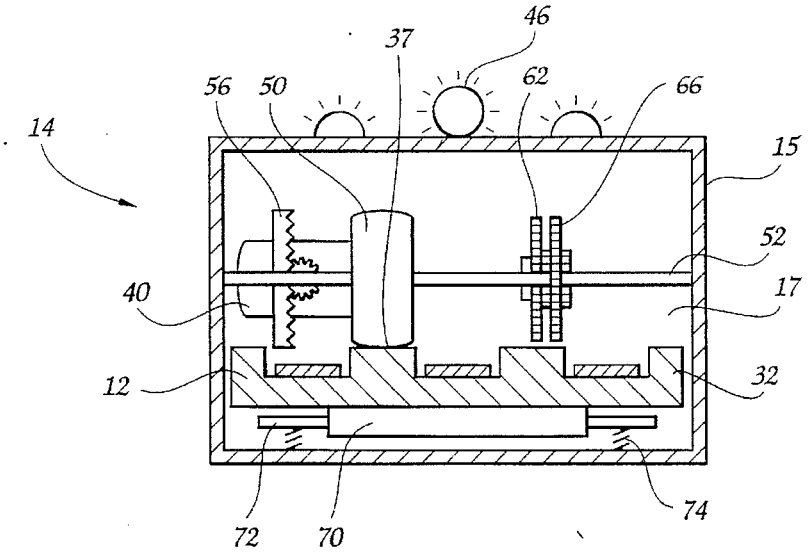
FIG. 5 is a rear end cross sectional view of the vehicle of the present invention mounted to the track and illustrating the drive arrangement of the vehicle.
Figure 6:
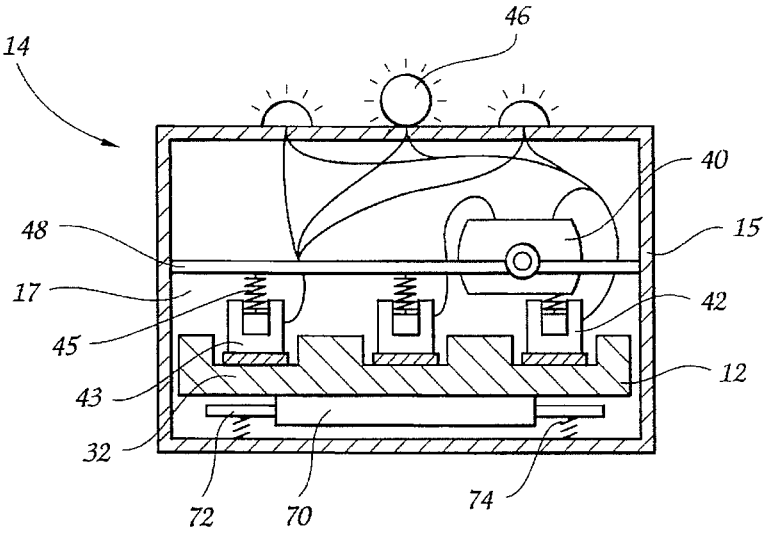
FIG. 6 is a front end cross-sectional view of the vehicle of the present invention illustrating the electrical connections and an auxiliary vehicle light system.
Figure 7:
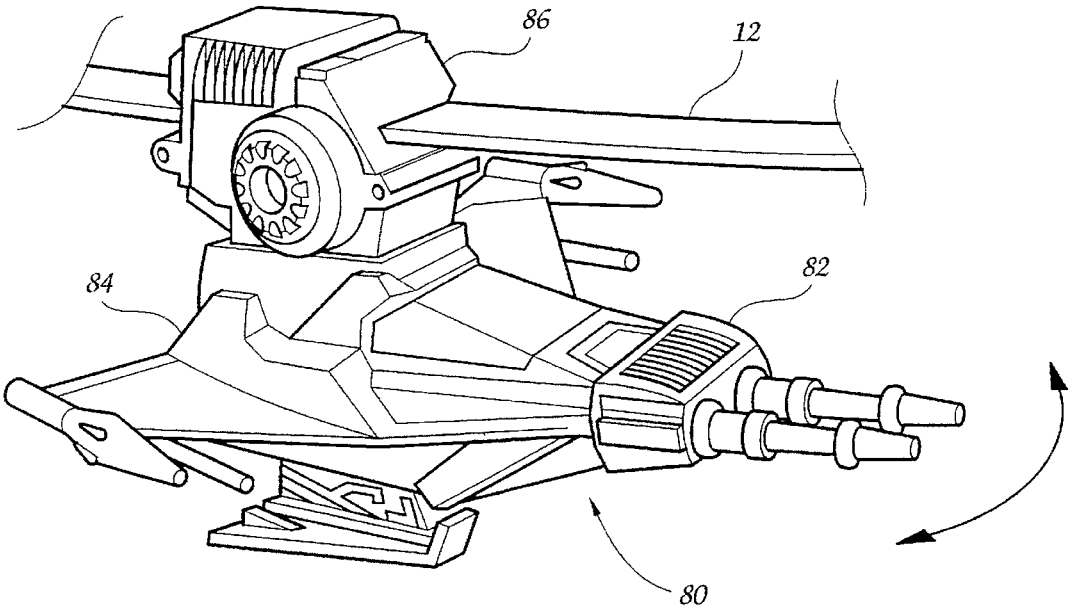
FIG. 7 is a perspective view of a vehicle according to one preferred embodiment of the present invention illustrating the apparent direction of travel thereof.

The vehicle 14 of the present invention may take on various forms. As illustrated in FIGS. 1 and 7, the body or shell of the vehicle 14,80 is in the configuration of a winged aircraft or space craft, however, the construction is not limited to that design. In that regard, FIGS. 4, 5, and 6 illustrate the body of the vehicle 14 in a schematic manner as box-like.

Figure 4:
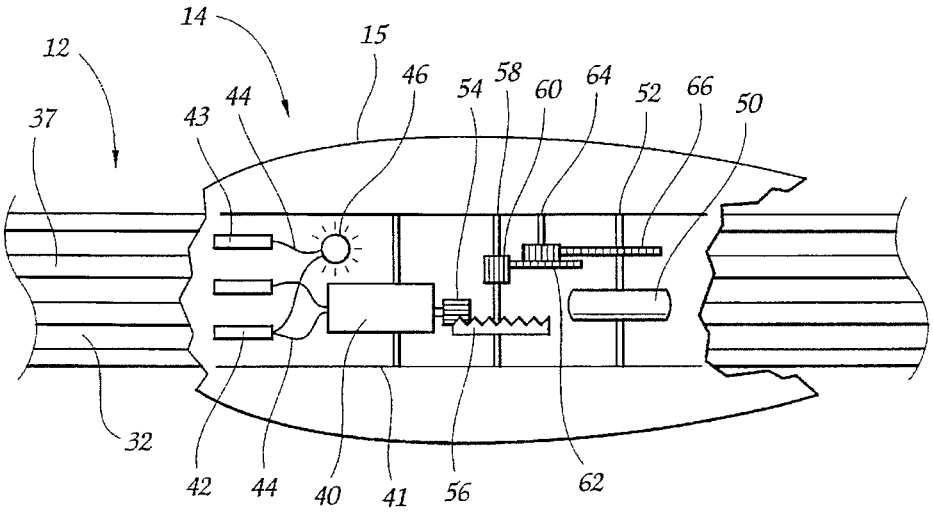
FIG. 4 is a top plan view of the vehicle of the present invention mounted to the track, with the vehicle body broken away to illustrate the operative components within the vehicle.

Referring now to FIG. 4, the vehicle 14 is illustrated in a fragmentary fashion to illustrate the layout of the operative components thereof and to illustrate the manner in which the vehicle 14 encounters the track 12. The vehicle 14 includes a body 15 which, as previously stated, may be configured to resemble any number of vehicle types. The body 15 has an opening 17 formed therethrough, through which the track 12 must be passed for operative engagement with the vehicle. Although illustrated as a lengthwise opening extending from one end of the vehicle 15 to the other, it is contemplated that the opening may be formed as a slot, open to the side or may extend widthwise with respect to the vehicle 15. Contained with the body 15, an internally mounted frame 41 provides mounting support for an electric motor 40 and other drive system components to be explained presently. The electric motor 40 provides the motive force to propel the vehicle 14 along the track 12. A power source is contained within the controller 16 and provides electricity to the vehicle 14 through the electrical conductors 32.

Electrical contact connectors 42 are provided which engage with the electrical conductors 32 to provide DC current to the electric motor 40 through conventional wiring 44. The electrical contact connectors 42 are relatively narrow generally planar metallic strips pivotably attached on one end to the internal frame 41 with the lower surface thereof configured for contact with the track-mounted electrical conductors 32. As seen in FIG. 6, the other end of the electrical contact connectors are mounted to a cross-brace 48, which extends traversely within the internal frame 41, using biasing springs 45. The biasing springs 45 apply a downwardly directed force to the electrical contact connectors 42 to maintain contact and therefore electrical communication between the motor 40 and the conductors 32.

Two of the three electrical conductors 32 are intended to receive and conduct electrical current of a positive polarity, while the third electrical conductor 32 is intended to receive and conduct electrical current of a negative polarity. One of the positive conductors 32 and the negative conductor 32 are contacted by the electrical contact connectors 42 of the vehicle to supply electrical power to the motor 40 through conventional wiring 44. The other positive conductor 32 engages with a third electrical contact connector 43 and, along with the negative connector 42, independently supplies power to a vehicle auxiliary circuit which may take the form of lights 46, as illustrated, through conventional wiring 44. The lights 46 are operable separately from the vehicle propulsion, as will be explained in greater detail hereinafter. While lights 46 are discussed and illustrated, it is contemplated that the third electrical contact connector 43 can provide power to other auxiliary functions as well, such as missile launchers, bomb release mechanisms, sirens, noise makers, or other lighting, weapons, or sound systems. While three conductors are illustrated, it is contemplated that several conductors could be utilized to provide greater interactive control over a number of auxiliary systems. As may be expected, the polarity of the electricity to the conductors 32 in contact with the motor contact connectors 42 may be reversed for reversing direction of the motor and thereby reversing direction of the vehicle 14 as it moves along the track 12.

Figure 13:
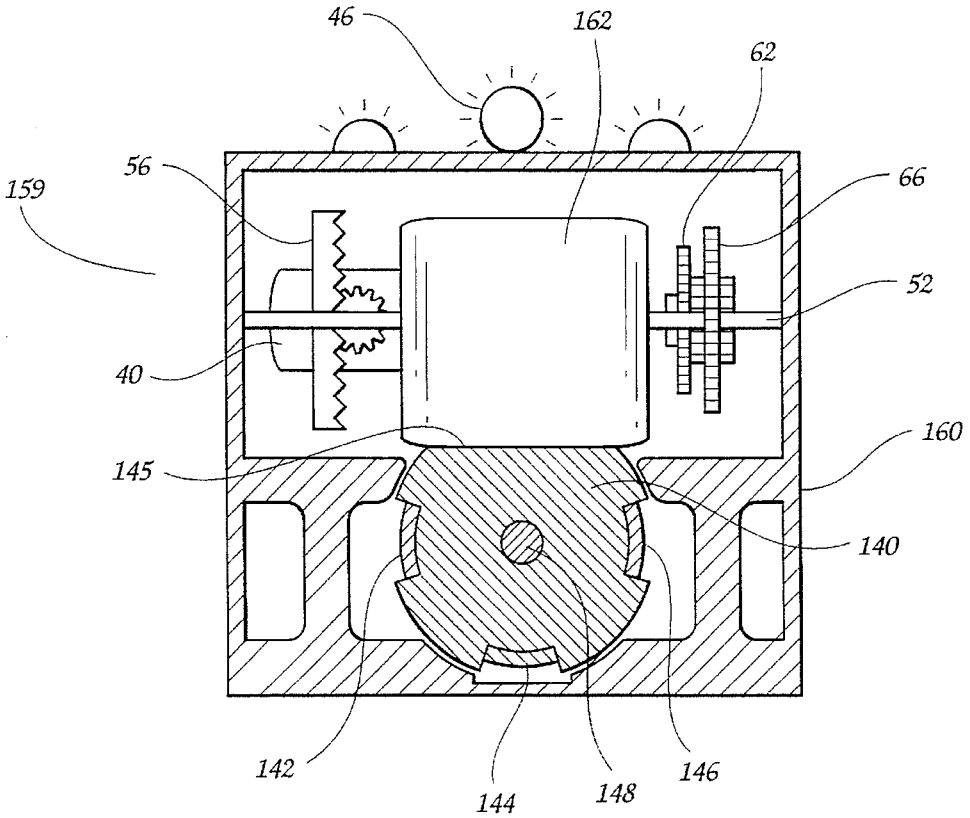
FIG. 13 is a rear end cross-sectional view of the vehicle of the present invention mounted to the track having a semi-circular cross-sectional configuration and illustrating the drive arrangement of the vehicle.
Figure 14:
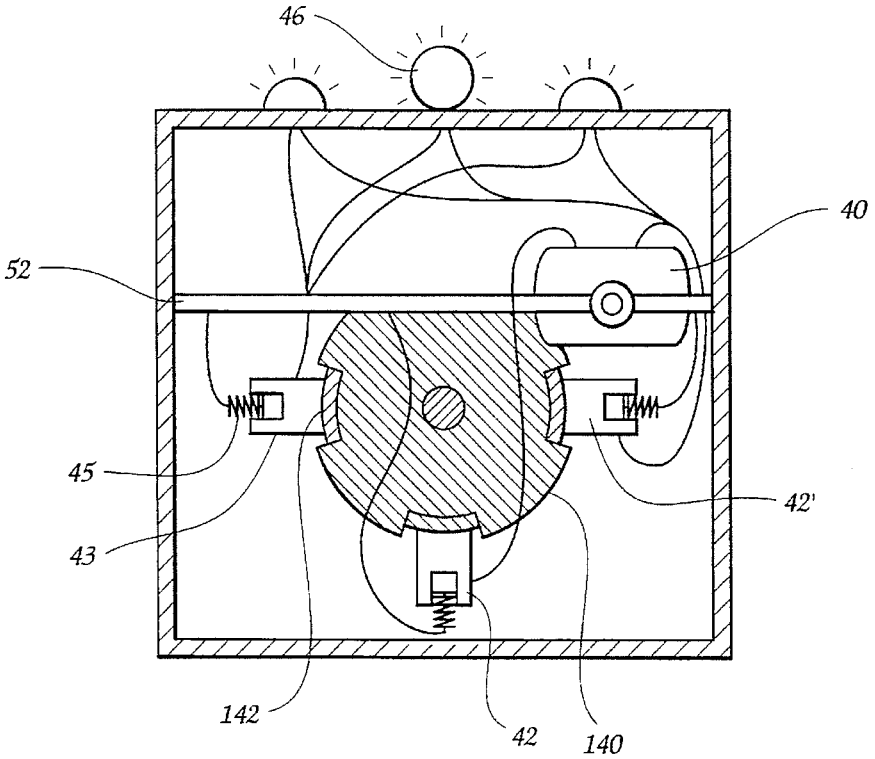
FIG. 14 is a front end cross-sectional view of the vehicle of the present invention illustrating the electrical connections and an auxiliary vehicle light system when used with the semi-circular cross-sectional track configuration.

The output of the electric motor 40 is communicated to a drive wheel 50 through a gearing system and a series of shafts, all of which are mounted traversely within the vehicle body 15 in the internal frame 41. More specifically, the output of the electrical motor 40 is taken from an armature mounted pinion gear 54 mechanically communicating with a crown gear 56 which transmits the rotary motion of the pinion gear 54 90° to a gear shaft 58 to which the crown gear 56 is fixed. A second drive gear 60 is affixed to the gear shaft 58 and meshes with and rotates a step down gear 62 which is mounted to an idler spindle 64. The step down gear 62 meshes with a final drive gear 66 which is attached to a drive shaft 52 along with the drive wheel 50 whereby rotation of the final drive gear 66 rotates the drive shaft 52, which in turn rotates the drive wheel 50. The drive wheel 50 is in peripheral engagement with one of the raised surfaces 37 of the track 12 which provides frictional contact therebetween for propulsion of the vehicle 14. To maintain frictional driving engagement of the drive wheel 50 with the drive surface 37, a roller 70 is mounted on a spindle 72 which in turn is mounted to the lower interior surface of the vehicle body 15 using biasing springs 74 which maintain contact between the lower surface of the track 12 and the pressure roller 70. This arrangement places the track 12 intermediate the pressure roller 70 and the electrical contact connectors 42,43 effectively placing the vehicle 14 in spring biased suspension for travel along the track 12, with the pressure roller 70 maintaining the electrical contact connectors 42,43 in contact with the electrical conductors 32. FIGS. 5 and 6 illustrate the manner in which the track 12 passes through the vehicle 14 and FIG. 5 shows the manner in which the drive wheel 50 engages the track surface. FIGS. 13 and 14 illustrate the vehicle when used with the partially round track configuration illustrated in FIGS. 12*a* and 12*b*. As can be seen in FIG. 13, the larger drive surface 145 provided with the partially round track 140 allows the use of a larger drive wheel 162 providing an increased surface area for frictional engagement. This alternative vehicle 159 includes a support structure 160 through which the track 140 may pass. The larger driving wheel 162 provides increased traction which in turn provides enhanced traction for propelling vehicles of increased weight due to the addition of auxiliary systems or other features. FIG. 14 illustrate the manner in which the electrical connectors 42,43 engage the conductive strips 142,144,146 around the rounded portion of the track 140.

Figure 15A:
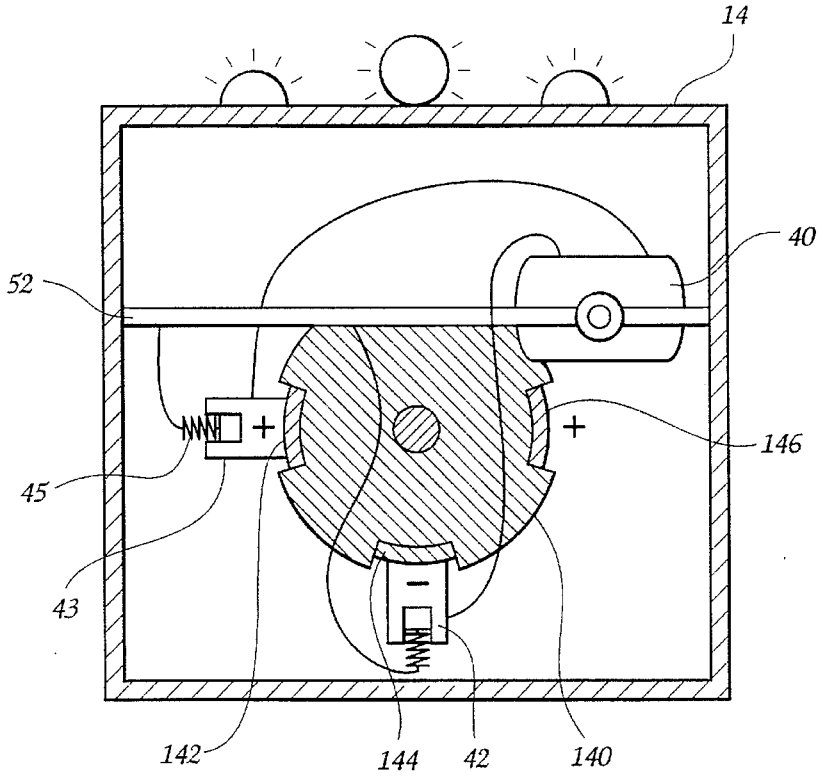
FIG. 15 illustrates the operation of two vehicles on a single track, FIG. 15*a* being a front end cross-sectional view of a first vehicle in electrical communication with a first positive polarity strip and the negative polarity strip and FIG. 15*b* being a similar view of a second vehicle on the same track in electrical communication with a second positive polarity strip and the negative polarity strip.
Figure 15B:
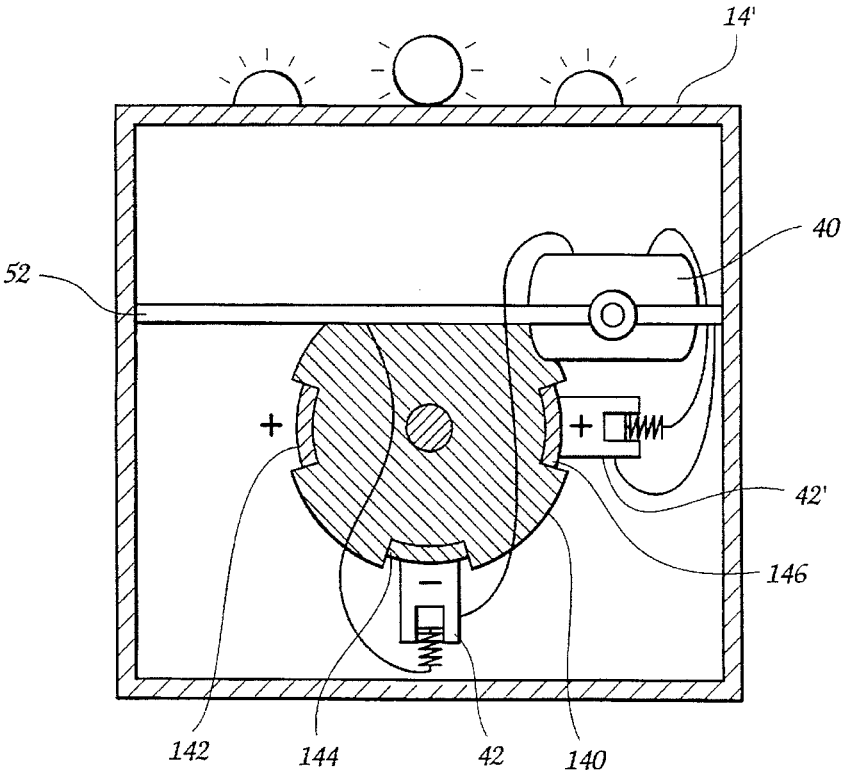

The use of a plurality of conductive strips 142,144,146 allows the use of at least two vehicles on a single track. As illustrated in FIG. 15*a*, a first vehicle 14 may tap electrical power from a first conductive strip 142 having a positive polarity and a second conductive strip 144 having a negative polarity. The first vehicle 14 does not use the third conductive strip 146 having a positive polarity. As illustrated in FIG. 15*b*, a second vehicle 14' does not use the first conductive strip 142 having a positive polarity but rather uses the second conductive strip 144 having a negative polarity and the third conductive strip 146 having a positive polarity. By selective application of electric power to each positive strip 142,146, each respective vehicle may be individually controlled for independent propulsion and movement along the track. As may be expected, if additional strips of a positive polarity are used in a track having a different cross-sectional configuration, more vehicles may be accommodated or each of the vehicles illustrated in FIGS. 15*a* and 15*b* may be equipped with auxiliary systems as illustrated in FIG. 14.

It should be understood that the criteria for multiple vehicles or multiple functions remains that a selectively controllable positive polarity voltage must be available for each vehicle propulsion system and each auxiliary function. Beyond that, the configurations are limited by only available electric power and the number of electrically conductive strips available. It is contemplated that the hexagonal configuration illustrated in FIG. 12*b* could accommodate five conductive strips, four of which may be of positive polarity, thereby providing the ability to accommodate two independently operable vehicles each having one independently operable auxiliary system. If the track has an octagonal cross-sectional configuration, six surfaces are available for the disposition of positive polarity conducting strips, thereby providing a track which will accommodate three independently operable vehicles with three independently operable auxiliary systems.

It is to be noted with reference to FIGS. 5, 6, 13, 14, 15*a*, and 15*b* that FIGS. 5 and 13 illustrate the one rear end portion of the vehicle 14 for purpose of depicting the vehicle's drive train and the electrical contact connectors 42 and wiring 44 are therefore omitted for clarity. On the other hand, FIGS. 6, 14, 15*a*, and 15*b* illustrate the other end of the vehicle 14 to depict the electrical transmission components and the vehicle gearing and drive system is therefore omitted for clarity.

A vehicle according to another preferred embodiment of the present invention is illustrated in FIG. 7, there depicted as futuristic space vehicle 80. The vehicle 80 is streamlined and includes a very defined front end portion 82 and a rear end portion 84. A drive motor housing 86 is attached to the upper portion of the vehicle 80 for mating the vehicle 80 with the track 12 and allowing the vehicle 80 to be driven therealong.

Since reversing the polarity of the current applied to a DC motor results in the motor's armature spinning in the opposite direction, it is a relatively easy task to provide the vehicle 80 with actual directions of travel either forwardly as depicted in FIG. 7 or rearwardly. Unfortunately, reversing the actual direction of travel of the vehicle would normally result in the vehicle apparently traveling backward which is generally considered unrealistic motion. Therefore, the vehicle 80 has been configured to rotate about the housing 86 whenever the actual direction of travel is reversed so that the apparent direction of travel, which is defined by the direction in which the front end 82 of the vehicle 80 is directed, is coincident with the actual direction of travel.

Figure 8:
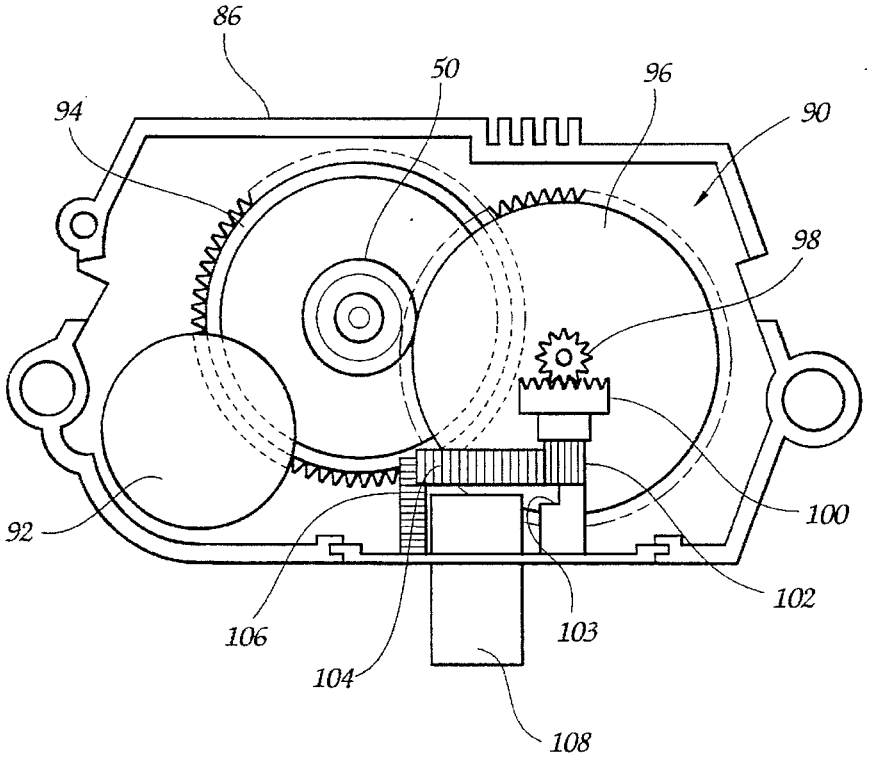
FIG. 8 is a left side view of the drive housing illustrated in FIG. 7 and broken away to illustrate the gear train for rotation of the vehicle illustrated in FIG. 7.
Figure 9:
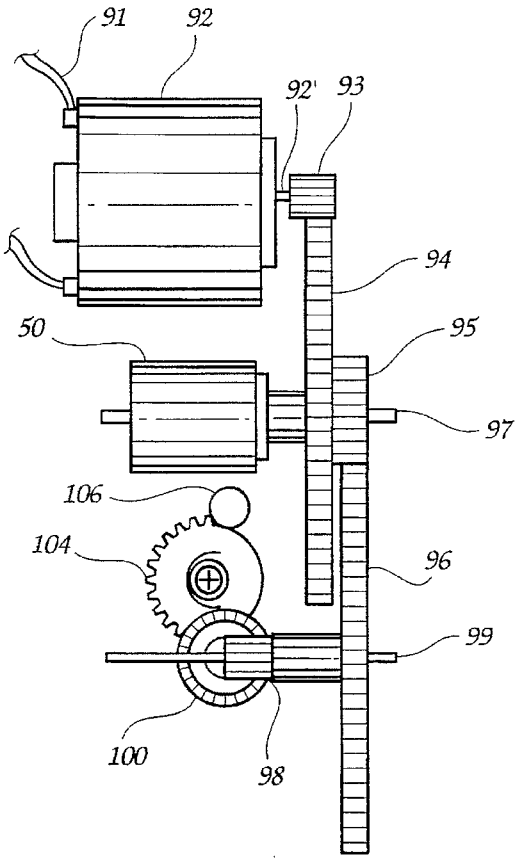
FIG. 9 is a top plan view of the gear train illustrated in FIG. 8.
Figure 10:
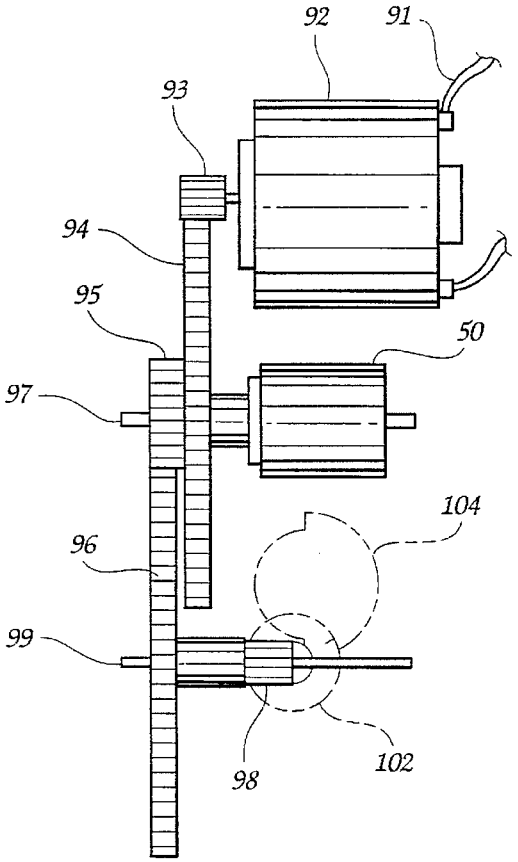
FIG. 10 is a bottom view of the gear train illustrated in FIG. 8.

To that end, and with reference to FIG. 8, the housing 86 includes a drive motor 92 and a gear train 90 for causing movement of the vehicle along the track as well as causing rotation of the vehicle to maintain the apparent direction of travel coincident with the actual direction of travel. Looking now at FIGS. 8 and 9 a first pinion gear 93 is mounted to the armature shaft 92' of the motor 92. The first pinion gear 93 is engaged and aligned with a first drive spur gear 94 which attached to a shaft 97 for driving the drive wheel 50 which operates in a manner as previously described. Also, a second pinion gear 95 is attached to the shaft 97 which drives the drive wheel 50 with the first drive spur gear 94 intermediate the drive wheel 50 and the second pinion gear 95. The second pinion gear 95 is mechanically linked to the vehicle rotational mechanism which consists of a second spur gear 96 being driven by the second pinion gear 95. The second spur gear 96 rotates on a shaft 99 which has a third pinion gear 98 disposed thereon. The third pinion gear 98 is mechanically connected to a crown gear 100 which, as can be seen in FIG. 8, is in orthogonal alignment with the third pinion gear 98. The crown gear 100 has fourth pinion gear 102 disposed along the same shaft and mounted vertically within the housing. This fourth pinion gear 102 is engaged with a gear having teeth along approximately one-half of radial outer surface. This half gear 104 is mounted within the housing 86 to a rotatable vehicle mount 108 which projects below the housing 86. Rotation of the half gear 104 will directly cause rotation of the vehicle mount 108 which rotates the vehicle 80. A resilient stop member 106 is mounted within the housing and acts as a blocking agent to stem the rotation of the half gear 104. As will be seen presently, the action of the half gear 104 and stop member 106 provide the alignment of the apparent direction of travel with the actual direction of travel. As can be seen in FIG. 9, the gearing arrangement is configured for optimum use of space with the motor 92, drive wheel 50, and rotational mechanism all in generally linear alignment with the larger spur gears 94,96 in generally parallel alignment adjacent and outboard the aforesaid components. This arrangement provides a compact drive arrangement for fitment within a housing which is not overly large in proportion to the vehicle which further enhances the realistic appearance of the vehicle of the present invention. Further, the vehicle 80 is removably mounted to the vehicle mount 108 so that the various vehicles may be adapted to a singular housing.

In operation, as the armature of the motor 92 revolves, the first pinion gear 93 revolves which in turn causes the drive spur gear 94 to revolve thereby driving the drive wheel 50, propelling the vehicle 80 along the track 12, and rotating the second pinion gear 95. The second pinion gear 95 in turn drives the second spur gear 96 which in turns drives the third pinion gear 98 attached thereto. The third pinion gear 98 causes rotation of the crown gear 100 which in turn causes rotation of the fourth pinion gear 102 attached thereto. While the motor is in operation, all of these gears will be in constant rotation. The half gear 104 is caused to rotate by the fourth pinion gear 102 throughout its range of motion. At the end of its range of motion, as seen in FIG. 9, the teeth of the half gear 104 are in abutment with the resilient stop member 106 and are constantly driven into abutment therewith by the fourth pinion gear 102. So long as the gears are rotating, the half gear 104 will be in reciprocating abutment with the resilient stop member 106, with the fourth pinion gear 102 directing the half gear 104 thereagainst. The stop member 106 will be directing the half gear 104 against the rotating teeth of the fourth pinion gear 102, and this interplay between the stop member 108 and the fourth pinion gear 102 causes the vehicle 80 to maintain its apparent direction of travel, as more fully explained below. This will occur so long as the gears are in rotation in one direction. Proper alignment of the vehicle 80 on the vehicle mount 108 will provide the proper direction of travel. Once the polarity of direct current to the motor 92 is reversed, the motor armature will revolve in the opposite direction, causing all of the gears in the gear train 90 to revolve in the opposite direction.

While gear rotation occurs in one direction, and as the vehicle 80 is traveling along the track 12, the half gear 104 is being constantly urged into abutment with the stop member 106 by the fourth pinion gear 102. Due to the position of the teeth on the half gear 104, one end tooth abuts the stop member 106 while the other end tooth is constantly being driven by contact with the teeth of the fourth pinion gear 102. Each gear-to-gear encounter between the pinion gear 102 and the half-gear 104 drives the half gear 104 against the resilient stop member 106. During the time when the half gear 104 encounters a spacing between teeth on the pinion gear 104, the resilient stop member 106 forces the half gear 104 in the opposite direction only to be met by the next oncoming tooth of the fourth pinion gear 102. This back and forth action continues so long as the gears are in rotation in a single direction. When the polarity to the motor 92 is reversed, the resilient stop member 106 and the pinion gear 103 are no longer at odds and the resilient stop member drives the half gear 104 into a meshing relationship with the fourth pinion gear 102 which is, by this time, revolving in the opposite direction as was defined by the previous rotation. This meshing engagement causes the half gear 104 to rotate with the pinion gear 102 throughout its limited range of motion until it encounters the resilient stop member 106 at the end of its approach from the opposite direction. This rotation of the half gear 104 through 180° is translated through the vehicle mount 108 which is caused to rotate 180° which maintains the apparent direction of travel coincident with the actual direction of travel. Thereafter, the above-discussed give-and-take action between the pinion gear 102 and the stop member 106 is resumed and continues until the actual direction of vehicle travel is changed once again. Enjoyment of play with the present invention is thereby enhanced as the space craft translates along the track and rotates into a forwardly appearing motion simultaneously.

With reference again to FIG. 1, the track storage assembly 18 includes a housing 24 which is shown broken away to reveal the manner in which the track 12 is stored therein. The aforementioned winding mechanism, shown only representatively at 22, is provided generally at the center of the housing 24 and allows the flexible track 12 to be wound as if onto a spooling device for selective winding and payout of the track 12. The clamp 20 is mounted exteriorly to the storage housing 24 for mounting the housing on a door or any other available support S as illustrated in FIG. 1. The clamp 20 may be of any conventional type, e.g., a screw type clamp as illustrated having two generally parallel plates with a handle driven screw extending therebetween such that when the screw is turned, the plates are driven closer together or farther apart depending on the direction the screw is turned.

The controller 16 is affixed to the opposite end of the track 12 from the storage assembly 18. The controller 16 basically includes a storage battery contained with a housing and operative switches to selectively place the storage battery in communication with the electrical conductors 32 for ultimate transmission of electrical power through the conductors 32 to the electrical contact connectors 42,43 of the vehicle 14. On the exterior of the controller 16, an on/off switch 68, which may be either discrete or variable, is provided to regulate the flow of electricity to the motor 40 of the vehicle 14 for propulsive movement of the vehicle 14 along the track 12. Preferably, the on/off switch 68 can supply power to the electric motor 40 in either a forward or a reverse mode, depending on the desired direction of travel of the vehicle 14, by switching the polarity of the conductors 32 as aforementioned. An auxiliary switch 70 provides electrical power to the auxiliary contact connector 43 and from there to the lights 46 or any of the other aforementioned optional auxiliary functions.

In operation, a child or other user can affix the storage unit 18 to any suitable support S using the clamp 20 and then pay out any desired length of track 12 for vehicle 14 operation thereon. The track 12 may then be arranged in any desired configuration, even to the extent that the vehicle 15 may be caused to climb vertically or encounter loops or inverted travel. At the opposite end of the track from the storage unit 18, the user grasps the controller 16 and may selectively manipulate the on/off switch 68 to propel the vehicle 14 in one direction or the other along the track and independently select the auxiliary functions using the auxiliary switch 70. At the end of play, the user may then wind the track 12 back into the storage unit 18 using the winder mechanism 22 and disconnect the clamp 20 from the support S.

Figure 11:
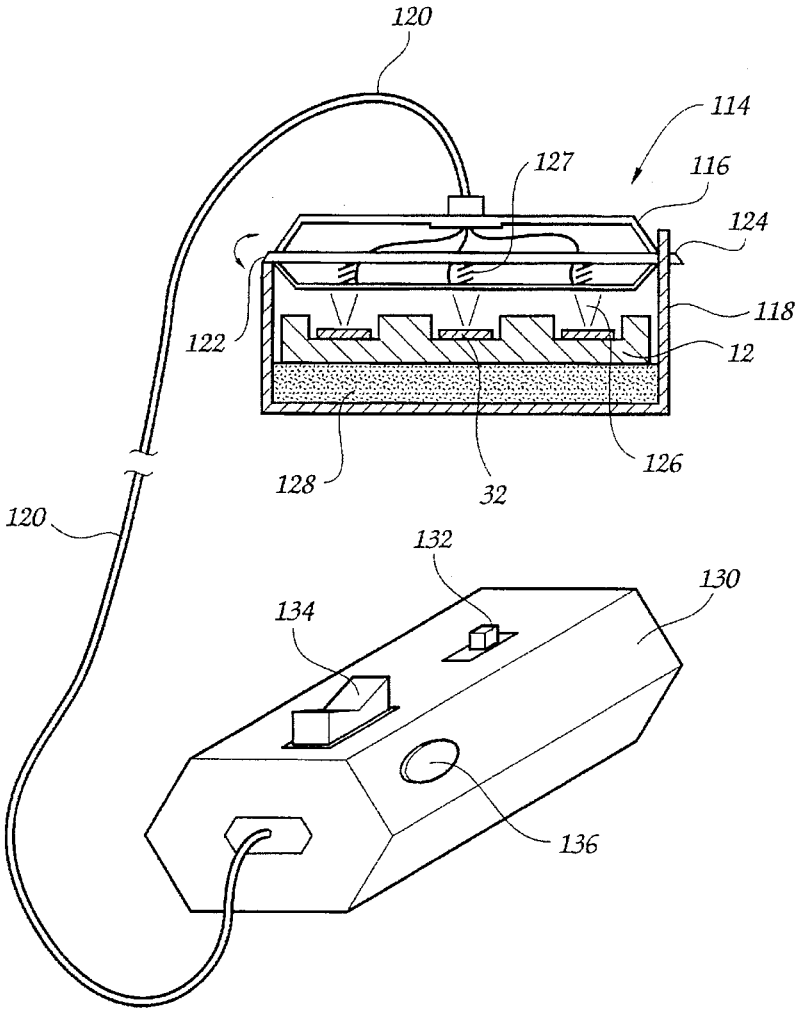
FIG. 11 is a diagrammatic view of the hand-held controller and the selectively removable power application device according to one preferred embodiment of the present invention.

Optionally, and according to another preferred embodiment of the present invention, the application of power to the track 12 need not be from a controller attached to the end of the track. In that regard, and with reference to FIG. 11, a clamp-on power application device 114 is provided with a hand-held controller 130. As is conventional, the controller 130 contains a battery and conventional wiring to provide an on/off switch 132, a direction-reversing toggle switch 134, and an auxiliary control switch 136, all of which are connected to the power application device 114 with conventional wiring 120. The power application device 114 may be selectively attached to and detached from the track 12 for application at various points therealong. FIG. 11 illustrates the power application device 14 attached to a flat track as seen in FIG. 3, but the concept is equally adaptable to any of the track configurations, such as those depicted in FIGS. 12*a* and 12*b*.

The power application device includes a housing 118 and a lid 116 which is attached to the housing 118 with a hinge 122. A conventional snap-lock mechanism 124 allows the lid to be locked into place on the track. Conical, electrically conductive contact pins 126 project outwardly and downwardly from the lid 116 and are biased downwardly with springs 127 attach thereto. The contact pins are wired to the controller through the conventional wiring 120. A biasing pad 128 is disposed underneath the track for maintaining the integrity of the electrical contact between the track 12 and the pins 126. The power application device 114 may be placed anywhere along an elongate track but is unsuitable for use with a continuous track circuit. In use, the track 12 is fitted within the housing 118 into contact with the biasing pad 128 and the lid 116 is closed onto the track 12 and is held in place by engagement of the snap lock 124 with the lid 116. Closing the lid 116 places the contact pins 126 into electrically conductive contact with the conductive strips 32 for application of power thereto.

Figure 16:
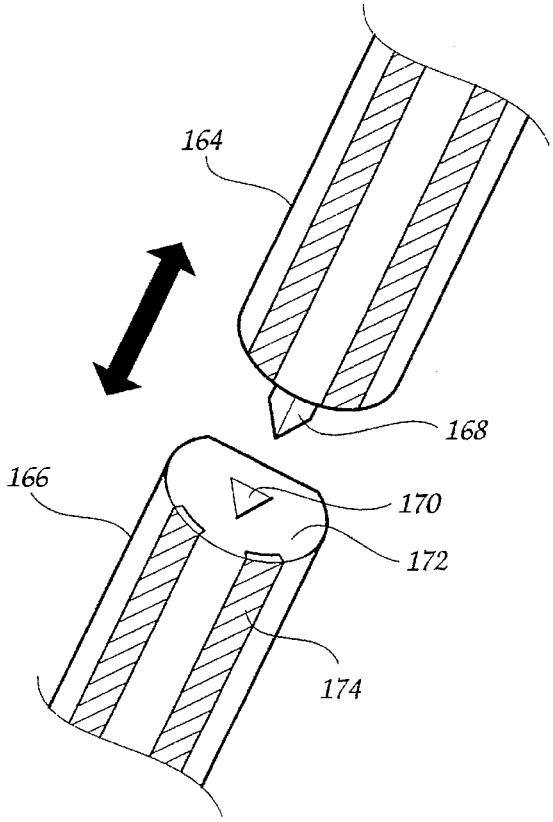
FIG. 16 is a perspective view of opposite ends of a track section illustrating the manner in which track sections are linked according to one aspect of the present invention.

Optionally, the track need not be a single elongate member but can be comprised of a plurality of removably joinable track sections. As seen in FIG. 16, a first track section 164 is matable with a second track section 166. To accomplish this mating, each track section 164,166 includes a recess 170 formed in one end 172 thereof. A corresponding projection 168 extends outwardly from the opposite end of the track section 164. The projection 168 and the recess 170 are configured for retaining the track sections 164,166 in a joined configuration either by frictional engagement as seen in FIG. 16 or by some form of stop member formed on the projection (not shown). When the track sections 164,166 are joined, the electrically conductive strips 174 are in electrical communication with one another. In this manner, a variety of track circuit configurations can be constructed using a plurality of the joinable track sections.

Figure 17:
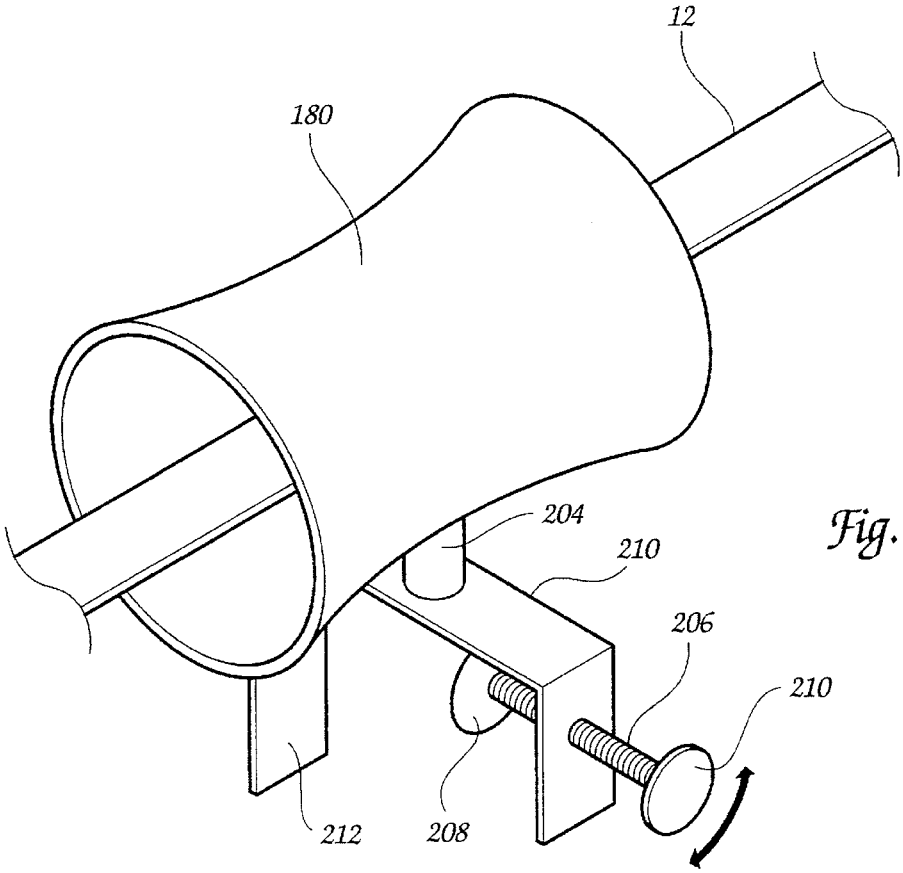
FIG. 17 is a perspective view a track mounting tunnel according to another preferred embodiment of the present invention illustrating the manner by which the track is directed and the arrangement for clamping the tunnel to a support object.

According to another preferred embodiment of the present invention, an alternate method for track mounting allows the use of continuous track circuits. This mounting device is illustrated in FIG. 17 and comprises a tunnel formed as a hollow cylinder whose walls taper inwardly from each end opening toward the center. As seen in FIG. 17, the track 12 is fed from one end of the tunnel 180 to the other. Since the track is merely laid in the tunnel, the taper allows the gradual displacement of the track above the cylinder walls by the incoming vehicle as it travels therethrough. These tunnels 180 may be used in various places to position and direct the track 12.

In order to mount the tunnel to a support surface, a clamping arrangement is provided including a generally C-shaped clamp 210 which is mounted to the tunnel 180 with a mounting member 204 which may, optionally, rotate adding versatility to the direction of the track circuit imparted by the tunnel 180. The clamp is configured for fitment over a door, chair, or other object and is adjustable to fit the object. In that regard, a threaded rod 206 is fitted through an opening formed in one of the clamp walls. A knob 210 is attached to the outer end of the rod 206 and a clamping pad 208 is attached to the inner end of the rod 206. The clamp is fitted over the door, chair, or other support member with a downwardly projecting clamp wall 212 in contact with the support. The knob 210 is then rotated, causing the rod to be driven inwardly and the contact pad 208 to be engaged with the support member. Tightening the rod 206 further secures the clamp to the support member.

Figure 18:
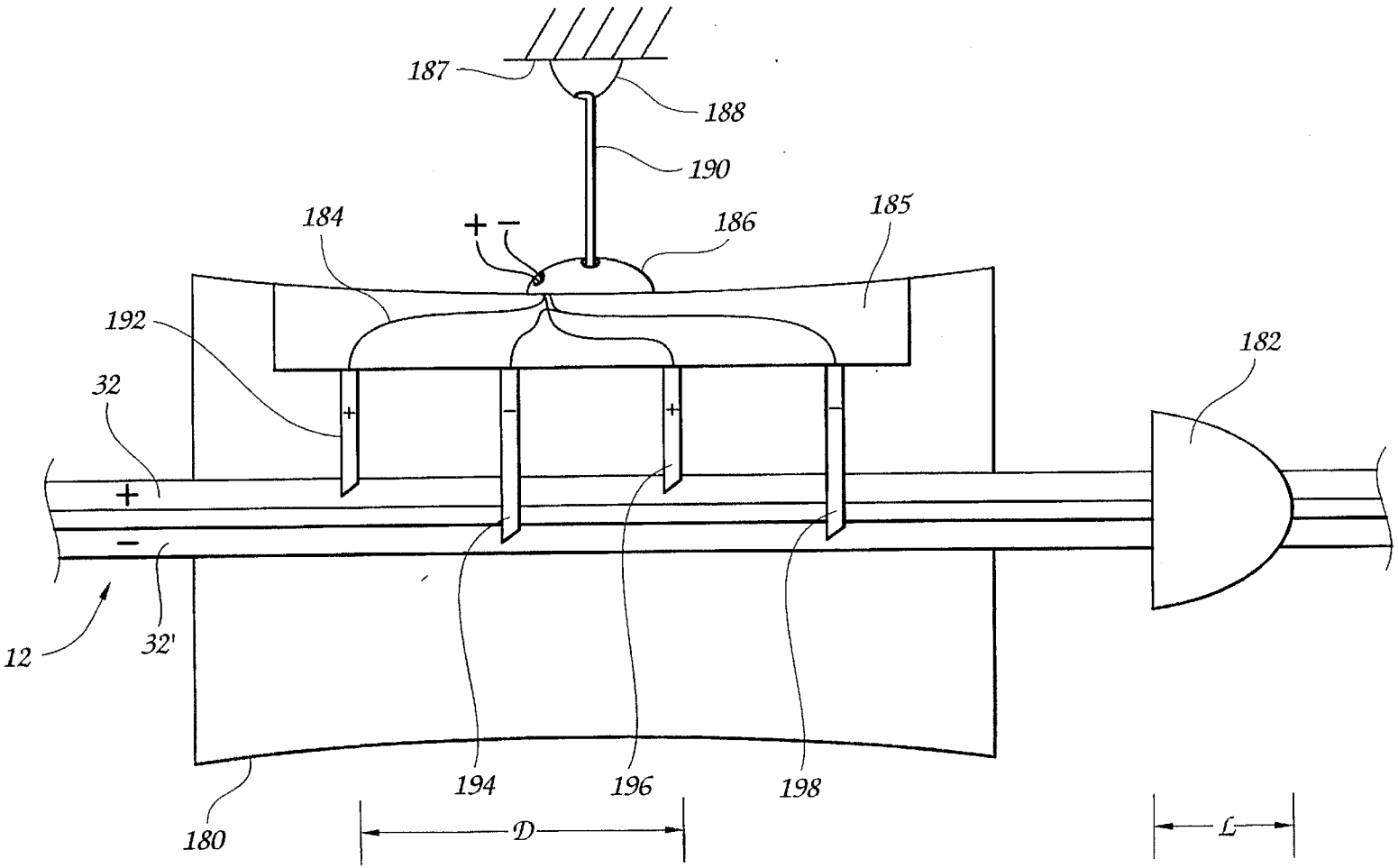
FIG. 18 is a diagrammatic view of a tunnel according to another preferred embodiment of the present invention having power applied to the track therethrough.

Turning now to FIG. 18, an optional tunnel mount is shown wherein the tunnel 180 is suspended from a support 187 using a support engagement member 188, a downwardly directed suspension member 190, and a tunnel mounted support 186 which is attached to the upper surface of the tunnel 180. The tunnel 180 may then be suspended from a horizontal surface. Optionally, the support engagement member 188 may be a suction cup.

Electric power may also be applied to the track 12 through the tunnel 180. To that end, it can be seen that the track 12 (shown diagrammatically in FIG. 18) is passed through the tunnel 180. A plurality of downwardly directed electrically conductive members 192,194,196,198 project downwardly from a wiring housing 185 disposed within the tunnel 180. The conductive members 192,194,196,198 are connected to the electrical power source through conventional wiring 184 within the wiring housing 185. There are two conductive members 192,196 of a positive polarity and two conductive members 194,198 of a negative polarity. The conductive members of like polarity are displaced a distance D from one another and are resiliently biased against the conductive strips 32 of the track 12. The vehicle 182 must be of a length L which is less than the distance D between conductive members of like polarity. Therefore, as the vehicle 182 enters the tunnel 180, it collides with the first positive conductive member 192, displacing it upwardly and out of contact with the positively polarized conductive strip 32. However, since the length L of the vehicle 182 is less than the distance between the first positive conductive member 192 and the second positive conductive member 196, the second positive conductive member 196 maintains contact with the positive conductive strip 32, thereby maintaining power to the track 12. A similar situation occurs with regard to the negative conductive members 194,198. So long as the length L of the vehicle 182 is less than the distance D between conductive members of like polarity, whenever one conductive member is displaced from contact with its respective conductive strip 32, the other conductive member will maintain contact. In this manner, power is constantly applied to the track.

Figure 19:
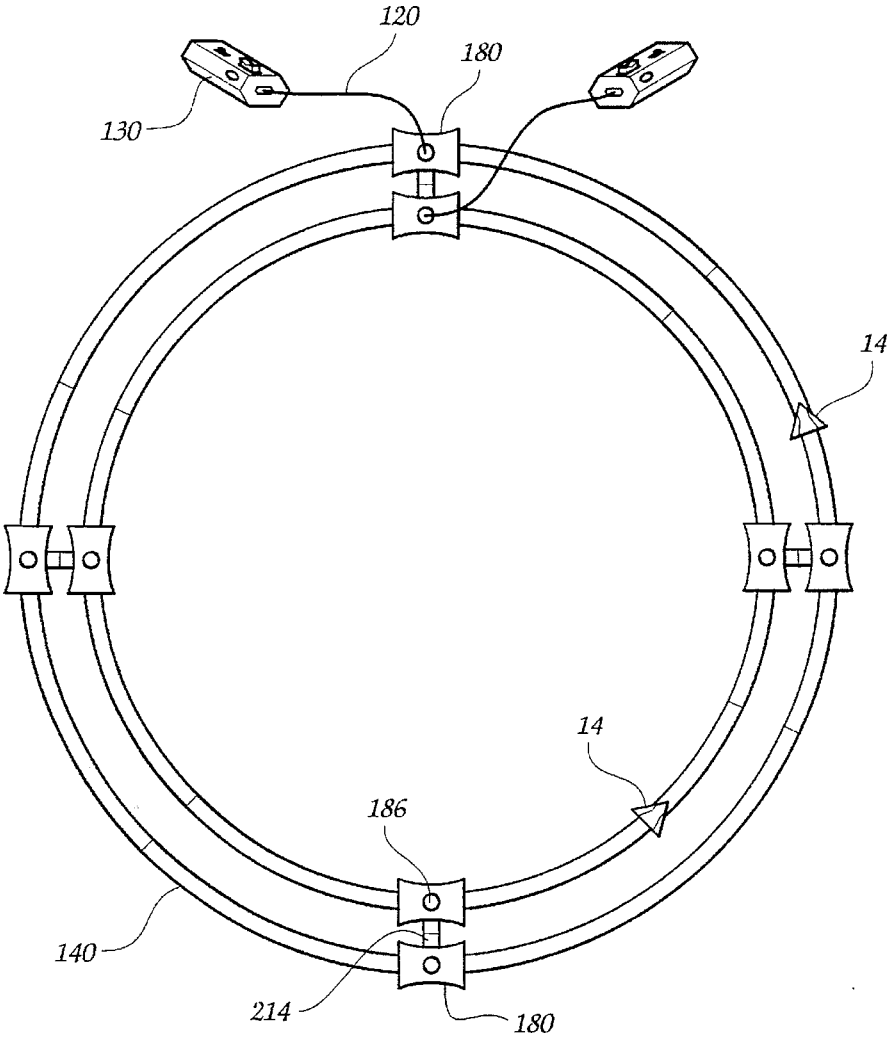
FIG. 19 is a top plan view of another embodiment of the present invention illustrating two track circuits arranged in a side-by-side relation.

The above type of power application is particularly suited for the embodiment of the present invention illustrated in FIG. 19. There, two continuous track circuits are constructed. The plurality of tunnels 180 are used to mount and guide the track. These tunnels 180 are fitted with mounting members 214 which allow the tunnels 180 to be attached to one another in a side-by-side relationship. A plurality of track sections 140 are fitted together in a manner illustrated in FIG. 16 to provide the continuous circular loop illustrated in FIG. 19. A pair of hand-held controllers 130, as illustrated in FIG. 11, are connected to the tunnels 180 which are constructed in a manner illustrated in FIG. 17 to apply power to the track 140. Vehicles 14 are disposed on each track and are simultaneously, independently operable. While the track circuits illustrated in FIG. 19 are circular, it is contemplated that various track circuits can be constructed using flexible track members which are joinable and tunnels which direct the track routing.

Figure 20:
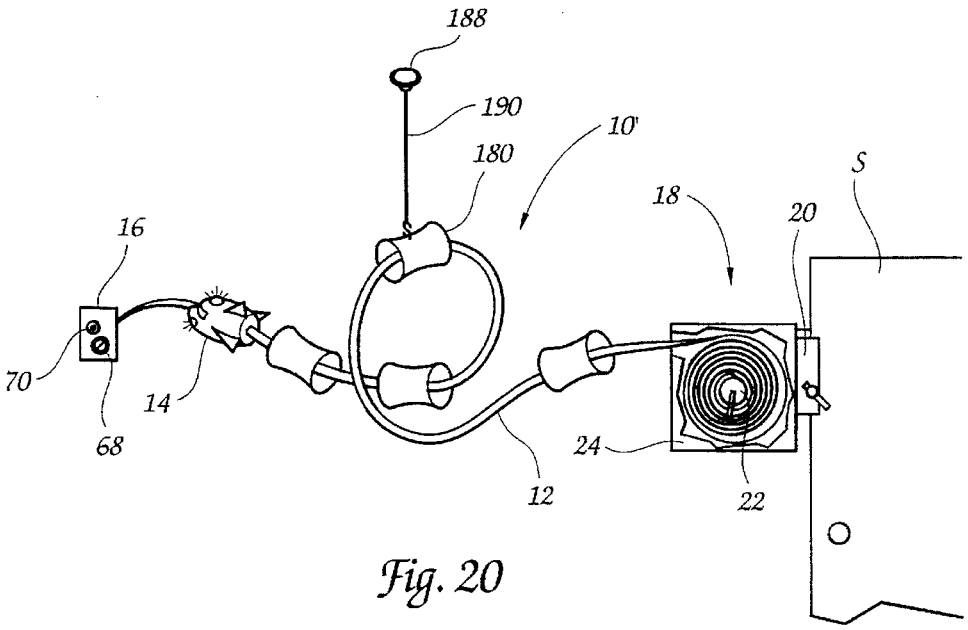
FIG. 20 is a perspective view of a toy vehicle and track assembly according to another preferred embodiment of the present invention.

Finally, it can be seen in FIG. 20 that the tunnels 180 can be used to mount a track circuit such as illustrated in FIG. 1 and previously described.

By the above, the present invention provides a neatly stored, easy to use toy vehicle and track assembly whose track is sufficiently flexible to enable it to assume any of a variety of dispositions and configurations to suit the user's imagination and desires. In contrast to conventional track systems, the track of the present invention is capable of being disposed at an elevation above ground level to simulate flight of the vehicle. Additionally, the invention effectively retains the vehicle on the track even if the track is turned upside down or extends at an upward or downward inclination.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A toy vehicle and track assembly comprising:

an electric power source;

track means formed as an elongate flexible member of a predetermined length having flexible electrical conducting means along the longitudinal extent thereof;

vehicle means having means for connecting said vehicle means to said track means, an electric motor, means for connecting said electric motor to said conducting means for communication with said electric power source, and drive means driven by said electric motor and disposed for engagement with said track means for propelling said vehicle means along said track means in an actual direction of travel, said vehicle means having a front end and a back end defining an apparent direction of travel with said front end projecting in said actual direction of travel;

means for maintaining said apparent direction of travel coincident with said actual direction of travel; and control means for selectively connecting and disconnecting said electric power source with said conducting means and for controlling the actual direction of travel of said vehicle means and mounting means for mounting said track means to a support object, said mounting means including at least one tunnel for supporting passage therethrough of said track means, said tunnel having means for mounting said tunnel to a support object, and having means for communicating said electrical power source with said conducting means, said electric communication means including at least two displaceable conductive members of a positive polarity and at least two displaceable conductive members of a negative polarity projecting from the interior walls of said tunnel and being resiliently biased into contact with said conducting means, said conductive members being in electrical communication with said electric power source, and being temporarily displaceable from contact with said conducting means by contact with said vehicle means as it passes through said tunnel, said conductive members being biased into recontacting said conducting means after said vehicle means has traveled therepast.

2. A toy vehicle and track assembly according to claim 1 wherein said control means includes switching means for changing the actual direction of travel of said vehicle means and said maintaining means reverses said apparent direction of travel responsive to action of said switching means.

3. A toy vehicle and track assembly according to claim 2 wherein said maintaining means includes a gear train connected to said electric motor and configured to rotate said vehicle means about an axis generally orthogonal to said actual direction of travel, and stop means disposed in communication with said vehicle means to arrest said rotation when said front end of said vehicle means projects in said actual direction of travel.

4. A toy vehicle and track assembly according to claim 3 wherein said gear train is disposed within a housing removably mounted to said track means and said vehicle means is rotatably mounted to said housing.

5. A toy vehicle and track assembly according to claim 4 wherein said electric motor and said drive means is disposed within said gear train housing.

6. A toy vehicle and track assembly according to claim 1 wherein said track means defines a plurality of longitudinal slots extending substantially the full longitudinal extent of said track means and said electrical conducting means includes a plurality of flexible electrically conductive strips disposed within said slots.

7. A toy vehicle and track assembly according to claim 6 wherein said means for connecting said electric motor to said conducting means includes a plurality of electrically conductive pin members mounted to said vehicle means in communication with said electric motor and resiliently biased into contact with said electrically conductive strips when said vehicle means is disposed on said track means.

8. A toy vehicle and track assembly according to claim 1 wherein said electrical conducting means includes a plurality of electrically conductive strips attached to said track means and further comprising a power application device including a housing for selective attachment to and detachment from said track means and a plurality of pin members disposed within said housing for electrical contact with said conductive strips, said pin members being in electrical communication with said electric power source for application of electric power to said conducting means.

9. A toy vehicle and track assembly according to claim 1 wherein said hand-held controller includes said electrical power source in the form of at least one dry cell battery.

10. A toy vehicle and track assembly according to claim 1 wherein said electrical conducting means includes at least three electrically conducting strips disposed along the longitudinal extent of said track means, two of said strips being of positive polarity and one of said strips being of negative polarity and said vehicle means includes at least two independently operable vehicular units, the electric motor of each said at least two vehicular units being in independent electrical communication with one of said positive polarity conductive strips and the electric motors of said at least two vehicular units being in common electrical communication with said negative polarity conductive strip, for independent, selectively controlled operation of said at least two vehicular units on said track means by application of electric power independently to each electric motor through connection to one of said positive polarity strips and said negative polarity strips.

11. A toy vehicle and track assembly according to claim 10 wherein said control means includes a power application device and a hand-held controller in electrical communication therewith, said power application device being selectively removably mountable to said track means in electrical communication with said conducting means.

12. A toy vehicle and track assembly according to claim 11 wherein said electrical conducting means includes a plurality of electrically conductive strips attached to said track means and said power application device includes a housing for selective attachment to and detachment from said track means, and a plurality of pin members disposed within said housing for electrical contact with said conductive strips, said pin members being in electrical communication with said electric power source for application of electric power to said conducting means.

13. A toy vehicle and track assembly according to claim 12 wherein said hand-held controller includes said electrical power source in the form of at least one dry cell battery.

14. A toy vehicle and track assembly according to claim 1 wherein said electrical conducting means includes a plurality or electrically conductive strips, said vehicle means includes an electrically operable auxiliary system, and said control means includes switching means for selectively independently operating said auxiliary means.

15. A toy vehicle and track assembly according to claim 14 wherein said auxiliary system includes a plurality of lights affixed to said vehicle means, said lights being selectively illuminable using said switching means.

16. A toy vehicle and track assembly according to claim 1 wherein said electrical conducting means includes a plurality of electrically conducting strips of positive polarity and a single electrically conductive strip of negative polarity disposed along the longitudinal extent of said track means and said vehicle means includes at least two independently operable vehicular units having electrically operable auxiliary systems, each vehicular unit electric motor being in electrical communication with one of said positive polarity strips and said negative polarity strip and each vehicular unit auxiliary system being in electrical communication with one of said positive polarity strips and said negative polarity strip for independent, selective operation of each vehicular unit electric motor and each vehicular unit auxiliary system.

17. A toy vehicle and track assembly according to claim 16 wherein said control means includes a power application device and a hand-held controller in electrical communication therewith, said power application device being selectively removably mountable to said track means in electrical communication with said conducting means.

18. A toy vehicle and track assembly according to claim 17 wherein said power application device includes a housing for selective attachment to and detachment from said track means and a plurality of pin members disposed within said housing for electrical contact with said conductive strips, said pin members being and in electrical communication with said electric power source for application of electric power to said conducting means.

19. A toy vehicle and track assembly according to claim 18 wherein said vehicle means includes an electrically operable auxiliary system and said control means includes switching means for selectively independently operating said auxiliary means.

20. A toy vehicle and track assembly according to claim 19 wherein said auxiliary system includes a plurality of lights affixed to said vehicle means, said lights being selectively illuminable using said switching means.

21. A toy vehicle and track assembly according to claim 1 wherein said vehicle means includes an electrically operable auxiliary system and said electrical conducting means includes three electrically conductive strips disposed along the longitudinal extent of said track means, two of said strips being of positive polarity and one of said strips being of negative polarity, one said strip of positive polarity and said strip of negative polarity being for said electric motor operation and one said strip of positive polarity and said strip of negative polarity being for operation of said auxiliary system.

22. A toy vehicle and track assembly according to claim 21 wherein said control means includes a power application device and a hand-held controller in electrical communication therewith, said power application device being selectively removably mountable to said track means in electrical communication with said conducting means.

23. A toy vehicle and track assembly according to claim 22 wherein said electrical conducting means includes a plurality of electrically conductive strips attached to said track means, said power application device includes a housing for selective attachment to and detachment from said track means and a plurality of pin members disposed within said housing for electrical contact with said conductive strips, said pin members being in electrical communication with said electric power source for application of electric power to said conducting means.

24. A toy vehicle and track assembly according to claim 23 wherein said hand-held controller includes said electrical power source in the form of at least one dry cell battery.

25. A toy vehicle and track assembly according to claim 24 wherein said electrical conducting means includes a plurality or electrically conductive strips, said vehicle means includes an electrically operable auxiliary system and said control means includes switching means for selectively independently operating said auxiliary means.

26. A toy vehicle and track assembly according to claim 25 wherein said auxiliary system includes a plurality of lights affixed to said vehicle means, said lights being selectively illuminable using said switching means.

27. A toy vehicle and track assembly according to claim 1 wherein said drive means includes a drive wheel and said track means includes a drive surface extending therealong for contact with said drive wheel.

28. A toy vehicle and track assembly according to claim 27 wherein said track means is formed with a predetermined cross-sectional configuration having a plurality of surfaces extending in separate longitudinal planes, at least one of said surfaces comprising said drive surface and at least two of said surfaces having said conducting means disposed thereon.

29. A toy vehicle and track assembly according to claim 28 wherein said conducting means includes a plurality of flexible electrically conductive strips disposed along said surfaces of said track means, at least one of said strips being of a positive polarity and at least one of said strips being of a negative polarity.

30. A toy vehicle and track assembly according to claim 29 wherein said control means includes a power application device and a hand-held controller in electrical communication therewith, said power application device being selectively removably mountable to said track means in electrical communication with said conducting means.

31. A toy vehicle and track assembly according to claim 30 wherein said power application device includes a housing for selective attachment to and detachment from said track means and a plurality of pin members disposed within said housing for electrical contact with said conductive strips, said pin members being in electrical communication with said electric power source for application of electric power to said conducting means.

32. A toy vehicle and track assembly according to claim 31 wherein said vehicle means includes an electrically operable auxiliary system and said control means includes switching means for selectively independently operating said auxiliary means.

33. A toy vehicle and track assembly according to claim 32 wherein said auxiliary system includes a plurality of lights affixed to said vehicle means, said lights being selectively illuminable using said switching means.

34. A toy vehicle and track assembly according to claim 27 wherein said track means is formed in a plurality of track sections of a predetermined length and includes means for detachably linking said track sections to another.

35. A toy vehicle and track assembly according to claim 34 wherein said linking means includes a recess formed in one end of each said track section and a corresponding projection formed in the other end of each said track section, whereby said projection from one of said track sections is configured to mate with and be removably retained by said recess formed in another of said track sections for removably retaining said track sections in a mated configuration.

36. A toy vehicle and track assembly according to claim 35 wherein said control means includes a power application device and a hand-held controller in electrical communication therewith, said power application device being selectively removably mountable to said track means in electrical communication with said conducting means.

37. A toy vehicle and track assembly according to claim 36 wherein said electrical conducting means includes a plurality of electrically conductive strips attached to said track means and said power application device includes a housing for selective attachment to and detachment from said track means and a plurality of pin members disposed within said housing for electrical contact with said conductive strips, said pin members being in electrical communication with said electric power source for application of electric power to said conducting means.

38. A toy vehicle and track assembly according to claim 1 wherein said tunnel mounting means includes an adjustable clamp for selective attachment to and detachment from a support object.

39. A toy vehicle and track assembly according to claim 1 wherein said track means is formed in a plurality of track sections of a predetermined length and includes means for detachably linking said track sections to one another.

40. A toy vehicle and track assembly according to claim 39 wherein said linking means includes a recess formed in one end of each said track section and a corresponding projection formed in the other end of each said track section, whereby said projection from one of said track sections is configured to mate with and be removably retained by said recess formed in another of said track sections for removably retaining said track sections in at mated configuration.

41. A toy vehicle and track assembly according to claim 1 wherein said conductive members are separated by a predetermined distance and said distance between conductive members of like polarity is greater than the length of said vehicle means.

42. A toy vehicle and track assembly according to claim 37 wherein said mounting means includes a plurality of tunnels for supporting passage therethrough of said track means, said tunnels having means for removably mounting said tunnels to one another in a generally side-by-side relationship.

43. A toy vehicle and track assembly comprising:

at least one electric power source;

track means formed as a plurality of removably joinable track sections formed from elongate flexible members of a predetermined length having flexible electric conducting means along the longitudinal extent thereof, said track means including means for linking said track sections to form a single unitary track;

vehicle means having means for connecting said vehicle means to said track means, an electric motor, means for connecting said electric motor to said conducting means for communication with said electric power source, drive means driven by said electric motor and disposed for engagement with said track means for propelling said vehicle means therealong;

control means for selectively connecting and disconnecting said electric power source with said conducting means for controlling movement of said vehicle means responsive to application of electric power to said electric motor; and means for mounting said track means to a support object and directing the route of said track means including a plurality of tunnels for passage therethrough of said track means, said tunnels including means for removably mounting said tunnels to support objects, wherein said at least one tunnel includes means for communicating said electrical power source with said conducting means, said electric communication means including at least two displaceable conductive members of a positive polarity and at least two displaceable conductive members of a negative polarity projecting from the interior walls of said tunnel and being resiliently biased into contact with said conducting means, said conductive members being in electrical communication with said electric power source, and being temporarily displaceable from contact with said conducting means by contact with said vehicle means as it passes through said tunnel, and being biased into recontacting said conducting means after said vehicle means has traveled therepast.

44. A toy vehicle and track assembly according to claim 43 and further comprising means for forming said track sections into at least two continuous track circuits, said vehicle means includes at least two vehicular units, each being independently operable on a respective track circuit and said tunnels include means for removably attaching said tunnels to one another for forming said at least two track circuits at least partially in a side-by-side relationship.

45. A toy vehicle and track assembly according to claim 43 wherein said track means defines a plurality of longitudinal slots extending substantially the full longitudinal extent of said track means and said electrical conducting means includes a plurality of flexible electrically conductive strips disposed within said slots.

46. A toy vehicle and track assembly according to claim 45 wherein said means for connecting said electric motor to said conducting means includes a plurality of electrically conductive pin members mounted to said vehicle means in communication with said electric motor and resiliently biased into contact with said electrically conductive strips when said vehicle means is disposed on said track means.

47. A toy vehicle and track assembly according to claim 43 wherein said control means includes a power application device and a hand-held controller in electrical communication therewith, said power application device being selectively removably mountable to said track means in electrical communication with said conducting means.

48. A toy vehicle and track assembly according to claim 43 wherein said electrical conducting means includes a plurality of electrically conductive strips attached to said track means and said power application device includes a housing for selective attachment to and detachment from said track means and a plurality of pin members disposed within said housing for electrical contact with said conductive strips, said pin members being in electrical communication with said electric power source for application of electric power to said conducting means.

49. A toy vehicle and track assembly according to claim 48 wherein said electrical conducting means includes at least three electrically conducting strips disposed along the longitudinal extent of said track means, two of said strips being of positive polarity and one of said strips being of negative polarity and said vehicle means includes at least two independently operable vehicular units, the electric motor of each said at least two vehicular units being in independent electrical communication with one of said positive polarity conductive strips and the electric motor of said at least two vehicular units being in common electrical communication with said negative polarity conductive strips, for independent, selectively controlled operation of at least two vehicular units on said track means by application of electric power independently to each electric motor through connection to one of said positive polarity strips and said negative polarity strips.

50. A toy vehicle and track assembly according to claim 43 wherein said track means is formed with a predetermined cross-sectional configuration having a plurality of surfaces extending in separate longitudinal planes, at least one of said surfaces comprising said drive surface and at least two of said surfaces having said conducting means disposed thereon.

51. A toy vehicle and track assembly according to claim 50 wherein said conducting means includes a plurality of flexible electrically conductive strips disposed along said surfaces of said track means, at least one of said strips being of a positive polarity and at least one of said strips being of a negative polarity.

52. A toy vehicle and track assembly according to claim 43 wherein said conductive members are spaced a predetermined distance apart and said distance between conductive members of like polarity is greater than the length of the vehicle means.

* * * * *